US011380246B2

(12) United States Patent
Kim et al.

(10) Patent No.: US 11,380,246 B2
(45) Date of Patent: Jul. 5, 2022

(54) ELECTROLUMINESCENT DISPLAY DEVICE HAVING PIXEL DRIVING

(71) Applicant: LG Display Co., Ltd., Seoul (KR)

(72) Inventors: Jaesung Kim, Paju-si (KR); Kiwoo Kim, Paju-si (KR); Sungwook Chang, Paju-si (KR); Hyungsoo Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/108,459

(22) Filed: Dec. 1, 2020

(65) Prior Publication Data

US 2021/0183303 A1 Jun. 17, 2021

(30) Foreign Application Priority Data

Dec. 13, 2019 (KR) ..... 10-2019-0166499

(51) Int. Cl.
*G09G 3/32* (2016.01)

(52) U.S. Cl.
CPC ..... *G09G 3/32* (2013.01); *G09G 2310/0267* (2013.01); *G09G 2310/0275* (2013.01)

(58) Field of Classification Search
CPC ..... G09G 3/32; G09G 2310/0275; G09G 2310/026; G09G 3/3258; G09G 3/30; G09G 3/3233
See application file for complete search history.

(56) References Cited

U.S. PATENT DOCUMENTS 10,004,124 B1 * 6/2018 Ko ..... H01L 27/3244
2013/0002616 A1 * 1/2013 Kim ..... H01L 27/1214 345/204
2014/0198085 A1 * 7/2014 Park ..... G09G 3/3233 345/212
2014/0333686 A1 * 11/2014 Kim ..... G09G 3/3233 345/694
2014/0353616 A1 * 12/2014 Park ..... G09G 3/3233 438/34
2015/0187270 A1 * 7/2015 Lee ..... G09G 3/3266 345/76
2016/0012775 A1 * 1/2016 Jeong ..... G09G 3/3233 345/690
2016/0124491 A1 * 5/2016 An ..... G06F 1/3265 713/323
2017/0092191 A1 * 3/2017 An ..... G09G 3/3233
(Continued)

*Primary Examiner* — Ibrahim A Khan
(74) *Attorney, Agent, or Firm* — Fenwick & West LLP

(57) ABSTRACT

An electroluminescent display device comprises subpixels each including a pixel driving circuit driven in accordance with an initialization period, a sampling period and a light emission period. The pixel driving circuit includes a light emitting diode, a driving transistor including a gate connected to a first node, a drain connected to a second node, and a source connected to a third node, a first switching circuit turned on for the initialization period, providing an initialization voltage to the first node and providing a fixed voltage to the third node, a second switching circuit turned on for the sampling period, applying a data voltage to the third node and providing the initialization voltage to an anode of the light emitting diode, and a light emitting control circuit controlled by an emission signal and turned on for the light emission period to provide a high potential voltage to the third node.

12 Claims, 10 Drawing Sheets

(56) References Cited

U.S. PATENT DOCUMENTS

| | | | | |
|---|---|---|---|---|
| 2017/0124954 | A1* | 5/2017 | Park | G09G 3/3258 |
| 2018/0308918 | A1* | 10/2018 | Choi | G09G 3/3233 |
| 2019/0213958 | A1* | 7/2019 | Cho | G09G 3/3266 |
| 2019/0304365 | A1* | 10/2019 | Hyun | G09G 3/3233 |
| 2020/0312230 | A1* | 10/2020 | Bae | G09G 3/32 |

* cited by examiner

ELECTROLUMINESCENT DISPLAY DEVICE HAVING PIXEL DRIVING

CROSS-REFERENCE TO RELATED APPLICATIONS

This application claims the benefit of Republic of Korea Patent Application No. 10-2019-0166499 filed on Dec. 13, 2019, which is hereby incorporated by reference in its entirety.

BACKGROUND

Technical Field

The present disclosure relates to an electroluminescent display device comprising a pixel driving circuit, and more particularly, to an electroluminescent display device effective for variable frequency driving.

Description of the Related Art

With the advancement of the information technology, the market for a display device which is a connection medium between a user and information has grown. Various types of communications beyond information transfer based on text messages between users are actively ongoing. As the type of information changes, performance of a display device for displaying information has been developed. Therefore, various types of display devices such as an organic light emitting display device, a micro-LED device, a liquid crystal display (LCD) device, and a quantum dot light emitting display (QLED) device are increasingly used, and studies for a display device of high definition for enhancing clarity of information are actively ongoing.

An electroluminescent display device comprises a display panel including a plurality of subpixels, a driver circuit supplying a signal for driving the display panel, and a power supply supplying a power source to the display panel. The driving circuit includes a gate driving circuit for supplying a gate signal to the display panel and a data driving circuit for supplying a data signal to the display panel.

For example, the electroluminescent display device may display an image as a light emitting diode of a selected subpixel emits light if the gate signal and the data signal are supplied to the subpixel. The light emitting diode may be embodied based on an organic material or an inorganic material.

Since the electroluminescent display device displays an image based on light generated from the light emitting diode within the subpixel, the electroluminescent display device has various advantages, but needs to improve exactness of a pixel driving circuit for controlling light emission of the subpixel so as to improve quality of the image. For example, a threshold voltage of a driving transistor included in the pixel driving circuit may be compensated to improve exactness of the pixel driving circuit.

As resolution of the electroluminescent display device is increased and power consumption is increased, a driving technology for reducing power consumption of the electroluminescent display device is being developed. A frame rate may be lowered for a specific time period to reduce power consumption, whereby pixels may be driven at a low speed. For example, in case of a mobile model, normal driving may be performed at a frequency of 60 Hz, 120 Hz, etc. in a real-use mode, and low-speed driving may be performed at a frequency of 1 Hz, etc. in a standby mode, whereby power consumption may be reduced.

Also, if transistors included in a pixel driving circuit are embodied as P-type polysilicon transistors, a leakage current of a gate node of a driving transistor may occur during low-speed driving. Since occurrence of the leakage current makes a light emitting diode difficult to maintain the same luminance for one frame and increases a data update period, flicker may be seen.

Also, luminance deterioration of a first frame is generated due to hysteresis of the driving transistor during switching from a black screen to a white screen. Since luminance deterioration of the first frame causes high visibility during low-speed driving, quality of the electroluminescent display device may be deteriorated. Switching from the black screen to the white screen means a powered-on state of the electroluminescent display device, or substantially means switching from a screen of low luminance to a screen of high luminance. In this case, luminance deterioration of the first frame may be represented in the form of flicker or motion-blurring.

SUMMARY

The inventors of the present disclosure have recognized the aforementioned problems and invented an electroluminescent display device comprising a pixel driving circuit, which may reduce non-uniform luminance that may occur during driving of the display panel at a variable frequency, from occurring in the electroluminescent display device to which a driving method through frequency variation is applied The present disclosure has been made in view of the above problems, and it is an object of the present disclosure to provide an electroluminescent display device comprising a pixel driving circuit, which may reduce a leakage current of a gate node of a driving transistor.

It is another object of the present disclosure to provide an electroluminescent display device comprising a pixel driving circuit, which may reduce luminance deterioration of a first frame from occurring during screen switching of a display panel.

In addition to the objects of the present disclosure as mentioned above, additional objects and features of the present disclosure will be clearly understood by those skilled in the art from the following description of the present disclosure.

In accordance with an aspect of the present disclosure, the above and other objects can be accomplished by the provision of an electroluminescent display device comprising a plurality of subpixels included in an nth row and each including a pixel driving circuit driven in accordance with an initialization period, a sampling period and a light emission period. In this case, 'n' is a natural number. The pixel driving circuit includes a light emitting diode, a driving transistor including a gate connected to a first node, a drain connected to a second node, and a source connected to a third node, a first switching circuit turned on for the initialization period, providing an initialization voltage to the first node and providing a fixed voltage to the third node, a second switching circuit turned on for the sampling period, conducting the first node and the second node, applying a data voltage to the third node and providing the initialization voltage to an anode of the light emitting diode, and a light emitting control circuit controlled by an emission signal and turned on for the light emission period to provide a high potential voltage to the third node and deliver a driving current to the light emitting diode. In this case, a capacitor is connected to the first node and a high potential voltage line to which the high potential voltage is provided. Therefore, luminance deterioration occurring when the electroluminescent display device capable of being driven at a variable frequency is driven at a low speed, may be reduced.

In accordance with another aspect of the present disclosure, the above and other objects can be accomplished by the provision of an electroluminescent display device comprising a plurality of subpixels included in an nth row and each including a pixel driving circuit driven in accordance with an initialization period, a sampling period and a light emission period where n is a natural number. the pixel driving circuit includes a light emitting diode and a driving transistor, and is configured to initialize a voltage of a gate of the driving transistor during the initialization period, to perform threshold voltage compensation and data voltage charging of the driving transistor during the sampling period, and to make the light emitting diode emit light during the light emission period. The pixel driving circuit is configured to provide a fixed voltage to a source of the driving transistor during the initialization period.

Details of the other embodiments are included in the detailed description and drawings.

According to the embodiments of the present disclosure, a fixed voltage is applied to a source of a driving transistor at a step prior to a step of sensing a threshold voltage of the driving transistor among driving steps of the pixel driving circuit, whereby luminance deterioration, which may occur in a first frame during screen switching, may be reduced.

According to the embodiments of the present disclosure, transistors connected to a gate of the driving transistor may be embodied as N-type transistors, whereby a leakage current, which may occur in the gate of the driving transistor, may be reduced.

In addition to the effects of the present disclosure as mentioned above, additional advantages and features of the present disclosure will be clearly understood by those skilled in the art from the above description of the present disclosure.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Figure 1:
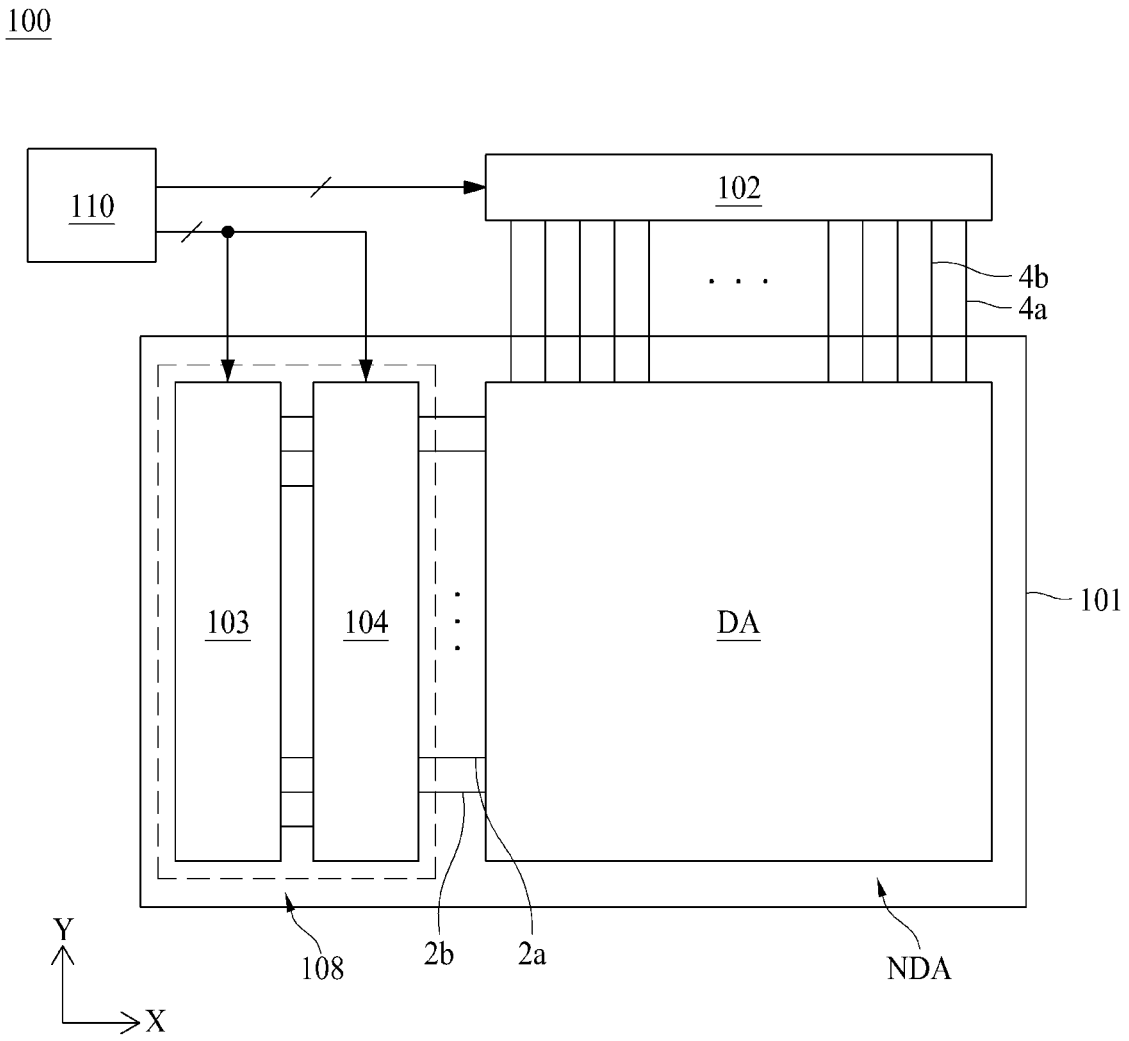
FIG. 1 is a block view illustrating an electroluminescent display device according to one embodiment of the present disclosure.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout the specification. In the following description, when the detailed description of the relevant known function or configuration is determined to unnecessarily obscure the important point of the present disclosure, the detailed description will be omitted. In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a position relationship, for example, when the position relationship is described as 'upon~', 'above~', 'below~', and 'next to~', one or more portions may be arranged between two other portions unless 'just' or 'direct' is used.

In describing a time relationship, for example, when the temporal order is described as 'after~', 'subsequent~', 'next~', and 'before~', a case which is not continuous may be included unless 'just' or 'direct' is used.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

In the present disclosure, a pixel driving circuit and a gate driving circuit, which are formed on a substrate of a display panel, may be embodied as N-type or P-type transistors. For example, the transistor may be embodied as a transistor having a metal oxide semiconductor field effect transistor (MOSFET) structure. The transistor may be a three-electrode device including a gate, a source, and a drain. The source is an electrode supplying a carrier to the transistor. In the transistor, the carrier moves from the source to the drain. In an N-type transistor, since the carrier is an electron, the electron moves from the source to the drain, and a voltage of the source is lower than a voltage of the drain. In the N-type transistor, since the electron moves from the source to the drain, a current moves from the drain to the source. In a P-type transistor, since the carrier is a hole, the voltage of the source is higher than the voltage of the drain in order for the hole to move from the source to the drain. In the P-type transistor, since the hole moves from the source to the drain, a current moves from the source to the drain. The source and the drain of the transistor may not be fixed and may be switched in accordance with an applied voltage.

Hereinafter, a gate on voltage may be a voltage of a gate signal for turning on a transistor. A gate off voltage may be a voltage for turning off the transistor. In the P-type transistor, the gate off voltage may be a gate high voltage (or off-level pulse), and the gate on voltage may be a gate low voltage (or on-level pulse). In the N-type transistor, the gate off voltage may be a gate low voltage (or off-level pulse), and the gate on voltage may be a gate high voltage (or on-level pulse).

Hereinafter, a pixel driving circuit and an electroluminescent display device comprising the same according to the embodiment of the present disclosure will be described with reference to the accompanying drawings.

FIG. 1 is a block view illustrating an electroluminescent display device according to one embodiment of the present disclosure.

Referring to FIG. 1, the electroluminescent display device 100 comprises a display panel 101, a data driving circuit 102 for supplying a signal to the display panel 101, a gate driving circuit 108, and a timing controller 110.

The display panel 101 may be categorized into a display area DA where an image is displayed, and a non-display area NDA where an image is not displayed. Pixels for displaying an image are disposed in the display area DA. Each of the pixels may include a plurality of subpixels for embodying an individual color. Each of the subpixels may be categorized into a red subpixel, a green subpixel and a blue subpixel. Each of the pixels may further include a white subpixel. A color of light emitted from subpixels included in one pixel may be a white color when all subpixels emit light in accordance with a subtractive color process.

Each pixel is connected with a data line formed along a Y-axis (or a column direction), and is connected to a gate line formed along an X-axis (or row direction). The pixels arranged along the X-axis are connected to the gate line and supplied with the same gate signal.

Each of the pixels includes a light emitting diode and a pixel driving circuit for allowing the light emitting diode to emit light with a predetermined brightness. The pixel driving circuit operates by being supplied with a data signal, a gate signal and a power signal. The data signal is supplied to the pixel through a data line 4*a* from the data driving circuit 102, the gate signal is supplied to the pixel through gate lines 2*a* and 2*b* from the gate driving circuit 108, and the power signal is supplied to the pixel through a power line 4*b*. The power line 4*b* may include a high potential voltage line supplying a high potential voltage to the pixel, a low potential voltage electrode supplying a low potential voltage to the pixel, an initialization voltage line supplying an initialization voltage to the pixel, and the other power line. The high potential voltage is a voltage higher than the low potential voltage. The gate lines 2*a* and 2*b* may include a plurality of scan lines 2*a* to which a scan signal is supplied, and a plurality of emission lines 2*b* to which a light emitting control signal is supplied.

The data driving circuit 102 generates a data voltage by converting data of an input image received from the timing controller 110 to a gamma compensation voltage under the control of the timing controller 110, and outputs the data voltage to the data lines 4*a*. The data driving circuit 102 may be formed on the non-display area NDA of the display panel 101 in the form of an IC (integrated circuit), or may be formed on the display panel 101 in the form of a chip on film (COF).

The gate driving circuit 108 includes a scan driving circuit 103 and an emission driving circuit 104. The scan driving circuit 103 sequentially supplies scan signals to scan lines 2*a* under the control of the timing controller 110. The nth gate line is arranged in the nth row. For example, the nth scan signal applied to the nth gate line may be synchronized with the mth data voltage. In this case, n and m are natural numbers. The emission driving circuit 104 generates emission signals under the control of the timing controller 110. The emission driving circuit 104 sequentially supplies the emission signals to the emission lines 2*b*. The scan driving circuit 103 and the emission driving circuit 104 include a plurality of stages for supplying signals the gate lines.

The gate driving circuit 108 may be formed in the form of an IC (integrated circuit), or may be formed in the form a GIP (gate in panel) built in a display panel 101. The gate driving circuit 108 may be arranged at each of left and right sides of the display panel 101 or may be arranged at one side of the left and right sides. Also, the gate driving circuit 108 may be arranged at an upper or lower side of the display panel 101.

The timing controller 110 receives digital video data of an input image and timing signals synchronized with the digital video data from a host system. The timing signals may include a data enable signal, a vertical synchronization signal, a horizontal synchronization signal, and a clock signal. The host system may be a television (TV) system, a set-top box, a navigation system, a DVD player, a Blu-ray player, a personal computer, a home theater system, or a mobile information device.

The timing controller 110 generates a data timing control signal for controlling an operation timing of the data driving circuit 102 and a gate timing control signal for controlling an operation timing of the gate driving circuit 108. The gate timing control signal includes a start pulse, a shift clock, etc. The start pulse may define a start timing at which a first output is generated from each of shift registers of the scan driving circuit 103 and the emission driving circuit 104. The shift register starts to be driven when the start pulse is input, and generates a first output signal at a first clock timing. The shift clock controls an output shift timing of the shift register.

A period when a gate signal and a data signal are once applied to all pixels arranged in a column direction in the display area DA may be referred to as one frame period. One frame period may be categorized into a scan period in which data are scanned from each of the gate lines connected to the pixels to the pixels to write data of an input image in each of the pixels, and a light emission period in which the pixels are lighted in accordance with the emission signals after the scan period. At the light emission period, the pixels may repeat lighting and light-out. The scan period may include an initialization period, a sampling period, etc. The sampling period may include a programming period. Initialization of nodes included in the pixel driving circuit and threshold voltage compensation and data voltage charging of a driving transistor are performed for the scan period, and a light emission operation is performed for the light emission period. The scan period correspond to several horizontal scanning time periods, and most of the one frame period is occupied by the light emission period.

Figure 2A:
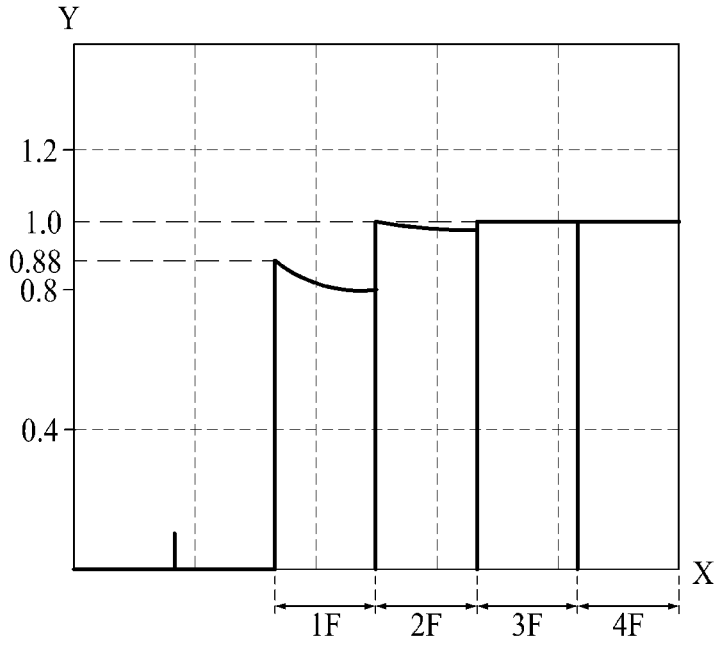
FIGS. 2A and 2B are graphs illustrating a luminance rate per frame according to a comparison example and the embodiment of the present disclosure.
Figure 2B:
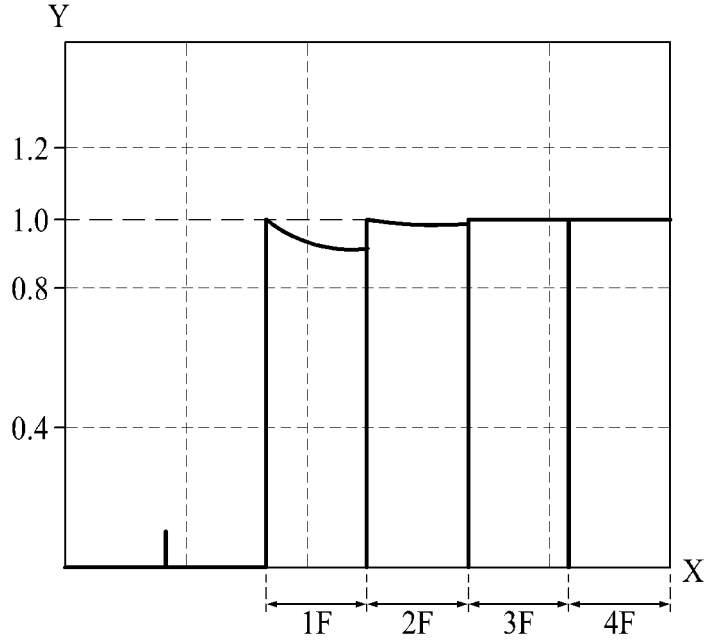

FIGS. 2A and 2B are graphs illustrating a luminance rate per frame according to a comparison example and the embodiment of the present disclosure.

As described above, a result that may be obtained through a transistor and depends on a previous state change without being determined by a current physical condition is referred to as hysteresis. Since luminance is expressed in the pixel driving circuit in accordance with a driving current provided by a driving transistor, non-uniform luminance may occur due to hysteresis of the driving transistor.

FIG. 2A is a graph illustrating a luminance rate per frame in a pixel driving circuit according to a comparison example. A luminance graph of a first frame IF, a second frame 2F, a third frame 3F, and a fourth frame 4F is shown in FIG. 2A. X-axis indicates time, and Y-axis indicates a relative value based on luminance of the fourth frame 4F.

In FIG. 2A, it is noted that luminance at a start of the first frame 1F is a value corresponding to 88% compared with the fourth frame 4F and luminance is reduced in accordance with the progress of the first frame 1F. It is also noted that luminance of the second frame 2F is reduced as compared with the fourth frame 4F. It is noted that luminance reduction remarkably occurs at the time when a black screen is switched to a white screen and luminance is recovered as frame is repeated. Also, luminance reduction has high visibility during low-speed driving. Therefore, in case of an electroluminescent display device intended to reduce power consumption by varying frequency, it is necessarily required to develop a pixel driving circuit that may reduce luminance reduction.

FIG. 2B is a graph illustrating a luminance rate per frame in a pixel driving circuit according to one embodiment of the present disclosure. A luminance graph of a first frame 1F, a second frame 2F, a third frame 3F, and a fourth frame 4F is shown in FIG. 2B. X-axis indicates time, and Y-axis indicates a relative value based on luminance of the fourth frame 4F.

In FIG. 2B, it is noted that luminance at a start of the first frame IF is almost equal to the fourth frame 4F and the same luminance is maintained from the second frame 2F to the fourth frame 4F. Although luminance is a little reduced for the first frame 1F, since luminance reduction is most remarkably visible at the time when a black screen is switched to a white screen, luminance reduction is reduced from occurring when the first frame 1F starts. As a result, it is regarded that a problem is solved. Therefore, the luminescent display device comprising a pixel driving circuit according to one embodiment of the present disclosure may reduce power consumption through low-speed driving.

Figure 3A:
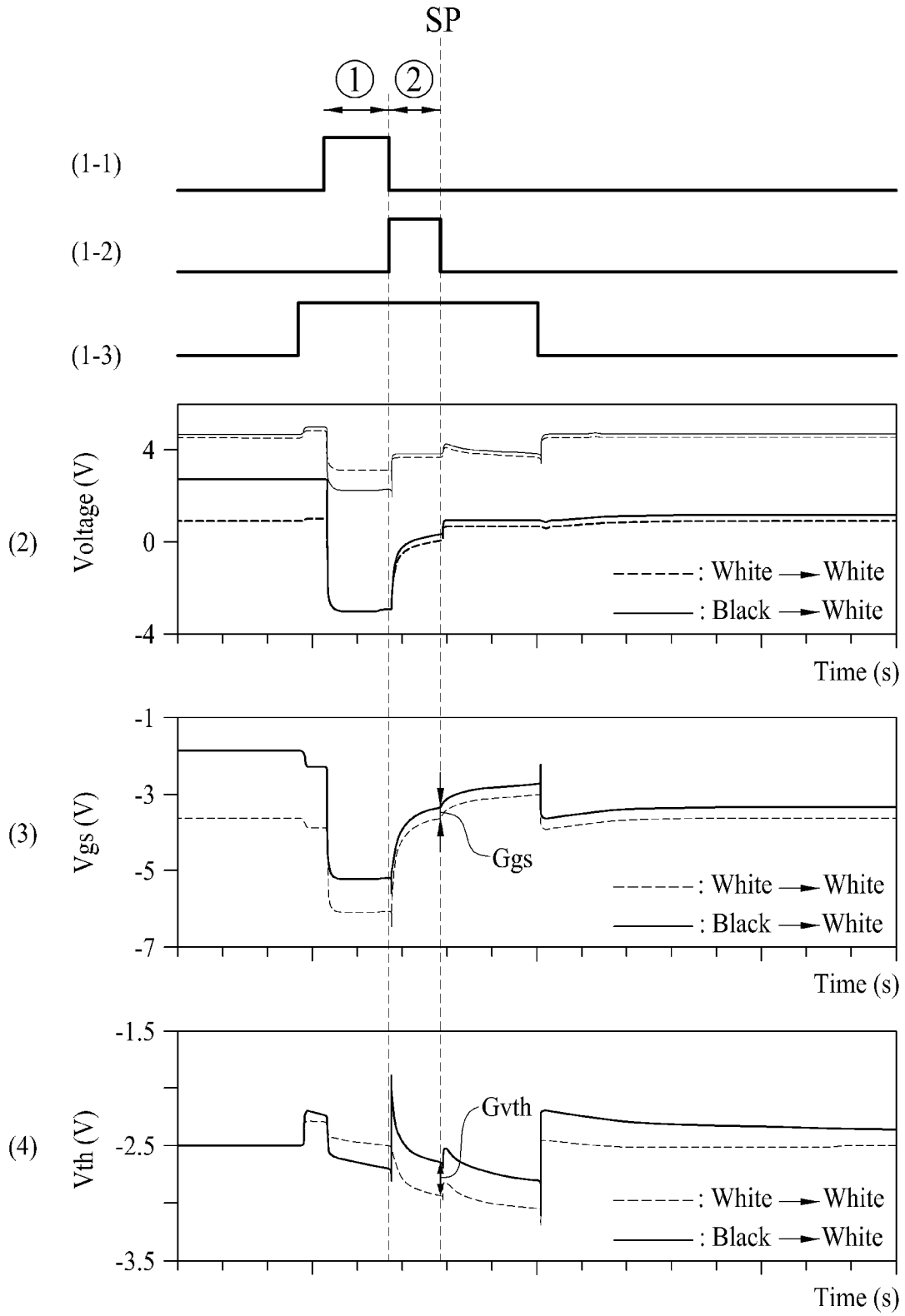
FIGS. 3A and 3B are graphs illustrating signal waveforms and voltage change, which may be observed in a pixel driving circuit, according to a comparison example and the embodiment of the present disclosure.
Figure 3B:
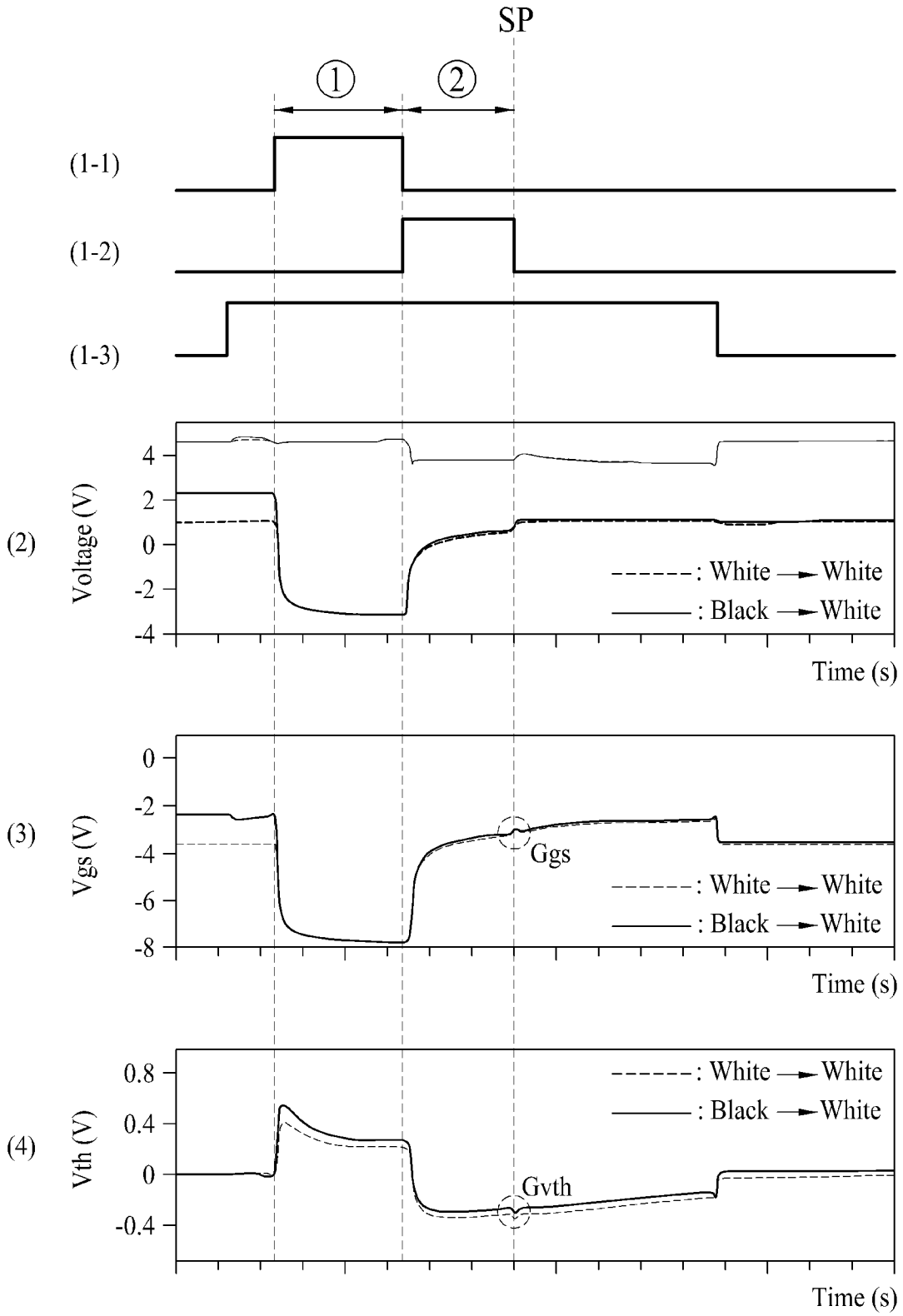

FIGS. 3A and 3B are graphs illustrating signal waveforms and voltage change, which may be observed in a pixel driving circuit, according to a comparison example and the embodiment of the present disclosure.

FIG. 3A shows graphs illustrating signal waveforms and voltage change, which may be observed in a pixel driving circuit, according to a comparison example. A graph (1-1) is a waveform of the (n−1)th scan signal S(n−1), a graph (1-2) is a waveform of the nth scan signal S(n), and a graph (1-3) is a waveform of the nth emission signal EM(n). The pixel driving circuit operates with an initialization period ① and a sampling period ②, wherein the initialization period ① is controlled in accordance with the (n−1)th scan signal S(n−1), and the sampling period ② is controlled in accordance with the nth scan signal S(n). The nth emission signal EM(n) is an off-level pulse for the initialization period ① and the sampling period ②.

Graph (2), graph (3), and graph (4) each illustrate a voltage that may be measured by the pixel driving circuit when the display panel is switched from a white screen to a white screen and when a black screen is switched to a white screen. When a white screen is switched to a white screen, a gray level difference may occur.

The pixel driving circuit includes a driving transistor supplying a driving current to a light emitting diode. The driving current is determined in accordance with source and gate voltages of the driving transistor.

The graph (2) illustrates a voltage change in a source node n3 of the driving transistor and a gate node n1 of the driving transistor. Referring to the voltage of the source node n3, it is noted that the voltage generated when the black screen is switched to the white screen for the initialization period ① is lower than the voltage generated when the white screen is switched to the white screen. The voltage of the gate node n1 of the driving transistor is regardless of a screen switching condition.

The graph (3) illustrates a gate-source voltage Vgs of the driving transistor. It is noted that the gate-source voltage Vgs of the driving transistor, which is generated when the black screen is switched to the white screen and the gate-source voltage of the driving transistor, which is generated when the white screen is switched to the white screen, differ from each other in the initialization period ① and the sampling period ②. A difference Ggs in the gate-source voltage of the driving transistor according to two screen switching conditions at the time SP when the sampling period ② ends is 298 mV, approximately.

The graph (4) illustrates a threshold voltage Vth of the driving transistor. It is noted that the threshold voltage of the driving transistor, which is generated when the black screen is switched to the white screen and the threshold voltage of the driving transistor, which is generated when the white screen is switched to the white screen, differ from each other in the initialization period ① and the sampling period ②. A difference Gvth in the threshold voltage of the driving transistor according to a screen switching condition at the time SP when the sampling period ② ends is 500 mV, approximately.

It is noted from the graphs (2), (3) and (4) that a voltage difference in the source node n3 of the driving transistor at the initialization period ① generates the difference Ggs in the gate-source voltage of the driving transistor and the difference Gvth in the threshold voltage of the driving transistor. This result shows that variation may occur in the threshold voltage Vth of the driving transistor in accordance with a state of a previous screen. This is referred to as hysteresis of the driving transistor. Since hysteresis of the driving transistor changes the sampled threshold voltage and the driving current of the driving transistor, non-uniform luminance may be caused at the screen switching timing.

FIG. 3B shows graphs illustrating signal waveforms and voltage change, which may be observed in a pixel driving circuit, according to one embodiment of the present disclosure. A graph (1-1) is a waveform of the (n−1)th scan signal S(n−1), a graph (1-2) is a waveform of the nth scan signal S(n), and a graph (1-3) is a waveform of the nth emission signal EM(n). The pixel driving circuit operates with an initialization period ① and a sampling period ②, wherein the initialization period ① is controlled in accordance with the (n−1)th scan signal S(n−1), and the sampling period ② is controlled in accordance with the nth scan signal S(n). The nth emission signal EM(n) is an off-level pulse for the initialization period ① and the sampling period ②.

In the same manner as the comparison example, graph (2), graph (3) and graph (4) each illustrate a voltage that may be measured by the pixel driving circuit when the display panel is switched from a white screen to a white screen and when a black screen is switched to a white screen. When a white screen is switched to a white screen, a gray level difference may occur.

The graph (2) illustrates a voltage change in a source node n3 of the driving transistor and a gate node n1 of the driving transistor. Referring to the voltage of the source node n3, it is noted that the same voltage is maintained for all periods including the initialization period ① and the sampling period ② regardless of the screen switching condition. Since two graphs display a black screen and a white screen for a previous light emission period, it is noted that the gate node n1 of the driving transistor has the same voltage for the other periods except the previous light emission period.

The graph (3) illustrates a gate-source voltage Vgs of the driving transistor. It is noted that the gate-source voltage Vgs of the driving transistor has almost no difference based on the screen switching condition in the initialization period ① and the sampling period ②. A difference Ggs in the gate-source voltage of the driving transistor according to two screen switching conditions at the time SP when the sampling period ② ends is 10 mV, approximately, reduced by about 3% compared with the comparison example.

The graph (4) illustrates a threshold voltage Vth of the driving transistor. It is noted that the threshold voltage Vth of the driving transistor has almost no difference regardless of the screen switching condition in all periods. The threshold voltage of the driving transistor that determines the driving current is determined at the time when the sampling period ② ends. A value of the threshold voltage Vth of the driving transistor at the time SP when the sampling period ② ends is 50.4 mV, approximately, reduced by about 10% compared with the comparison example.

From FIGS. 3A and 3B, the voltage difference in the source node n3 of the driving transistor at the initialization period ① generates a difference of each of the gate-source voltage Vgs and the threshold voltage Vth of the driving transistor. Therefore, a certain voltage may be applied to the source node n3 of the driving transistor at the initialization period ① of the first frame corresponding to the screen switching timing, so that there is no difference in the source node n3 of the driving transistor in accordance with the screen switching condition.

Hereinafter, the pixel driving circuit that may embody FIG. 3B will be described.

Figure 4A:
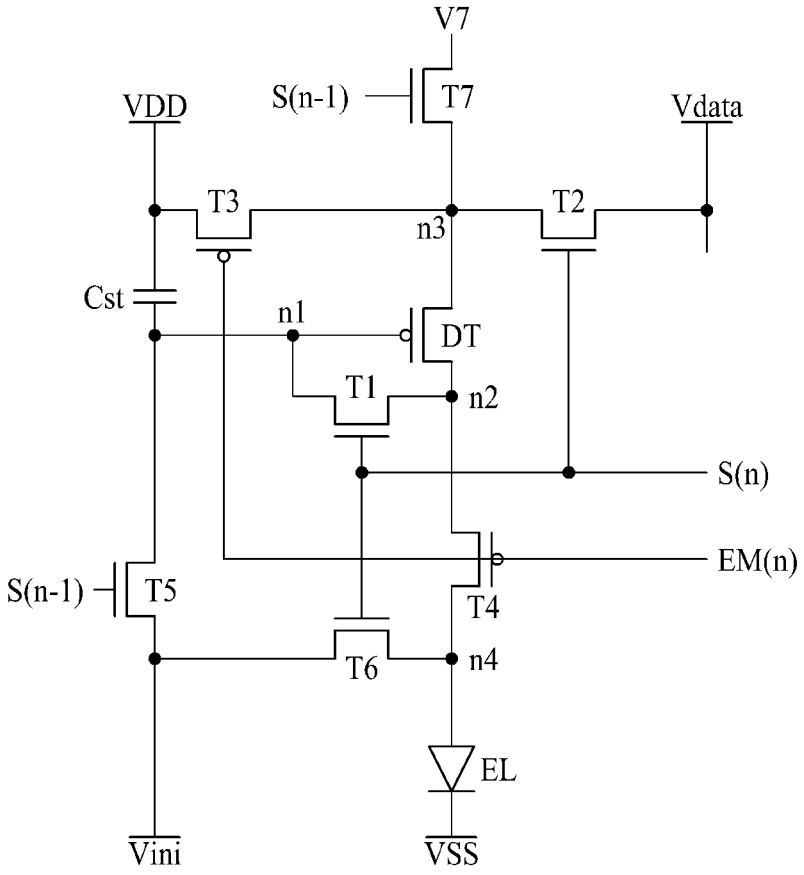
FIG. 4A is a view illustrating a pixel driving circuit according to one embodiment of the present disclosure.
Figure 4B:
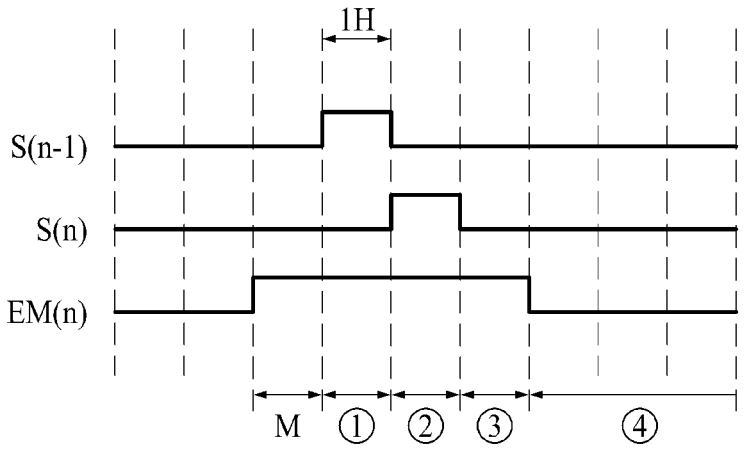
FIGS. 4B and 4C are waveforms illustrating signals input/output to a pixel driving circuit according to one embodiment of the present disclosure.
Figure 4C:
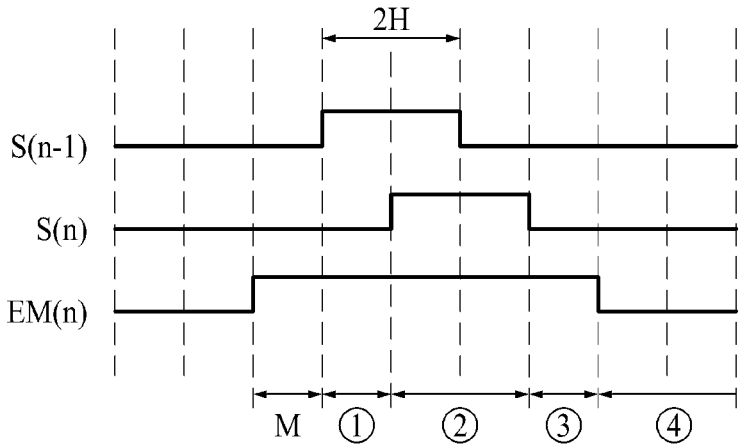

FIG. 4A is a view illustrating a pixel driving circuit according to one embodiment of the present disclosure, and FIGS. 4B and 4C are waveforms illustrating signals input/output to a pixel driving circuit. The pixel driving circuit shown in FIG. 4A corresponds to a description of pixels arranged in the nth row. It is noted that although FIG. 4A shows a specific structure of the pixel driving circuit according to one embodiment of the present disclosure, the structure of the pixel driving circuit is not limited thereto, and other structures of the pixel driving circuit may also be applicable, as long as a fixed voltage is provided to the node of the driving transistor during the initialization period.

Referring to FIG. 4A, the pixel driving circuit for supplying a driving current to the light emitting diode EL includes a plurality of transistors, and a capacitor. The pixel driving circuit according to one embodiment of the present disclosure is an internal compensation circuit that may compensate for a threshold voltage of the driving transistor DT.

A power voltage of a high potential voltage VDD, a low potential voltage VSS, and an initialization voltage Vini are applied to the pixel driving circuit, and a pixel driving signal of the nth scan signal S(n), the (n−1)th scan signal S(n−1), the nth emission signal EM(n), and a data voltage Vdata are applied thereto. The nth scan signal S(n) is a scan signal applied to the pixels arranged in the nth row, the (n−1)th scan signal S(n−1) is a scan signal applied to the pixels arranged in the (n−1)th row, and the nth emission signal EM(n) is an emission signal applied to the pixels arranged in the nth row.

Each of the scan signals S(n) and S(n−1) and the emission signal EM(n) has an on-level pulse or an off-level pulse in accordance with a certain time interval. The transistors according to one embodiment of the present disclosure may be embodied as PMOS and NMOS transistors. A turn-on voltage of the PMOS transistor is a gate low voltage (or on-level pulse), and its turn-off voltage is a gate high voltage (or off-level pulse). A turn-on voltage of the NMOS transistor is a gate high voltage (or on-level pulse), and its turn-off voltage is a gate low voltage (or off-level pulse).

The light emitting diode EL emits light using the amount of a current controlled by the driving transistor DT in accordance with the data voltage Vdata and expresses luminance corresponding to a data gray scale of an input image. The light emitting diode EL may include an anode, a cathode, and an organic compound layer arranged between the anode and the cathode. The organic compound layer may include, but is not limited to, a light emitting layer, a hole injecting layer, a hole transporting layer, an electron transporting layer, and an electron injecting layer. The anode of the light emitting diode EL may be connected to the driving transistor or an emission transistor controlling light emission of the light emitting diode EL. The cathode of the light emitting diode EL is connected to a low potential voltage electrode to which a low potential voltage VSS is applied.

The driving transistor DT is a driving device for controlling a current flowing in the light emitting diode EL in accordance with the gate-source voltage Vgs and may be a PMOS transistor. However, the present disclosure is not limited thereto, and the driving transistor DT may also be a NMOS transistor. The driving transistor DT includes a gate connected to a first node n1, a drain connected to a second node n2, and a source connected to a third node n3.

A first transistor T1 is turned on by the nth scan signal S(n) and connects the gate of the driving transistor DT with the drain of the driving transistor DT. The first transistor T1 is connected to the first node n1 and the second node n2.

A second transistor T2 is turned on by the nth scan signal S(n) and provides the data voltage Vdata to the third node n3. The second transistor T2 is connected to a data voltage line to which the data voltage Vdata is provided, and the third node n3.

A third transistor T3 is turned on by the nth emission signal EM(n) and provides the high potential voltage VDD to the third node n3. The third transistor T3 is connected to a high potential voltage line to which the high potential voltage is provided, and the third node n3.

A fourth transistor T4 is turned on by the nth emission signal EM(n) and provides the driving current provided by the driving transistor DT to the anode of the light emitting diode EL. The fourth transistor T4 is connected to the second node n2 and a fourth node n4. The fourth transistor T4 may be referred to as an emission transistor.

A fifth transistor T5 is turned on by the (n−1)th scan signal S(n−1) and provides the initialization voltage Vini to the first node n1. The fifth transistor T5 is connected to the first node n1 and an initialization voltage line to which the initialization voltage is provided.

A sixth transistor T6 is turned on by the nth scan signal S(n) and provides the initialization voltage Vini to the fourth node n4. The sixth transistor T6 is connected to the initialization voltage line and the fourth node n4.

A seventh transistor T7 is turned on by the (n−1)th scan signal S(n−1) and provides a voltage V7 to the third node n3. The seventh transistor T7 is connected to the third node n3 and a V7 voltage line to which the voltage V7 is provided. The V7 voltage V7 is a fixed voltage, and will be described later in detail.

A capacitor Cst includes two electrodes for forming capacitance, and the two electrodes are respectively connected to the first node n1 and the high potential voltage line.

The pixel driving circuit may be categorized into a first switching circuit, a second switching circuit, and a light emitting control circuit.

The first switching circuit of the pixel driving circuit according to one embodiment of the present disclosure is turned on by the (n−1)th scan signal S(n−1) to initialize the gate of the driving transistor DT, and may reduce luminance deterioration of the first frame from occurring by turning on the driving transistor DT for a certain time after applying the voltage to the source of the driving transistor DT. The first switching circuit may include the fifth transistor T5 and the seventh transistor T7. The first switching circuit may be embodied as an NMOS transistor, and the seventh transistor T7 may be embodied as a PMOS transistor as the case may be.

The second switching circuit of the pixel driving circuit according to one embodiment of the present disclosure is turned on by the nth scan signal S(n) to provide the data voltage Vdata to the third node n3, samples the threshold voltage of the driving transistor DT, and initializes the anode of the light emitting diode EL. The second switching circuit may be embodied as an NMOS transistor, whereby the gate driving circuit may not need additional scan driving circuit. The second switching circuit may include the first transistor T1, the second transistor T2, and the sixth transistor T6. The second switching circuit may be embodied as an NMOS transistor, and the second transistor T2 and the sixth transistor T6 may be embodied as PMOS transistors.

The light emitting control circuit of the pixel driving circuit according to one embodiment of the present disclosure is turned on by the nth emission signal EM(n) to provide a high potential voltage VDD to the third node n3 and provide the driving current to the light emitting diode EL. The light emitting control circuit is embodied as a PMOS transistor, and includes the third transistor T3 and the fourth transistor T4.

The (n−1)th scan signal S(n−1) and the nth scan signal S(n) provided to the first switching circuit and the second switching circuit are signals output from their respective stages included in the same scan driving circuit.

The first transistor T1 and the fifth transistor T5 connected with the gate of the driving transistor DT of the first switching circuit and the second switching circuit may be embodied as NMOS transistors to reduce a leakage current, which may occur in the gate of the driving transistor DT, thereby improving exactness of the driving current provided to the light emitting diode EL. For example, an active layer of the NMOS transistor may be an oxide semiconductor that includes any one or more of Indium, Gallium, and Zinc as main components. As the second transistor T2, the sixth transistor T6 and the seventh transistor T7 may be embodied as NMOS transistors, the gate line and the scan driving circuit may not be provided additionally, whereby the elements of the gate driving circuit may be reduced.

Referring to FIGS. 4B and 4C, FIG. 4B illustrates that the scan signals S(n−1) and S(n) are on-level pulses for one horizontal scanning time (1H Time), and FIG. 4C illustrates that the scan signals S(n−1) and S(n) are on-level pulses for two-horizontal scanning time (2H Time).

FIGS. 4B and 4C illustrate an initialization period ①, a sampling period ②, a holding period ③, and a light emission period ④. The (n−1)th scan signal S(n−1) is an on-level pulse at the initialization period ①, the nth scan signal S(n) is an on-level pulse at the sampling period ②, and the nth emission signal EM(n) is an on-level pulse at the light emission period ④. The holding period ③ and a margin period M allow the scan signals S(n−1) and S(n) not to be mixed with the emission signal EM(n) by making sure of one horizontal scanning time (1H time). In this case, the holding period ③ and the margin period M are not limited to one horizontal scanning time (1H Time). If an ideal scan signal is provided to the pixel driving circuit, the margin period M and the holding period ③ may be omitted.

In case of FIG. 4C, the sampling period ② has an on-level pulse period of the (n−1)th scan signal S(n−1) and the nth scan signal S(n) for one horizontal scanning time (1H Time). If the scan signals S(n−1) and S(n) correspond to the two-horizontal scanning time (2H Time) as shown in the graph of FIG. 4C, the (n−1)th scan signal S(n−1) and the scan signal S(n) may be driven by being overlapped with each other to make sure of the sampling period as much as the two-horizontal scanning time, whereby the threshold voltage of the driving transistor may be sensed more exactly.

Hereinafter, driving steps of the pixel driving circuit when the signals of FIG. 4B are input to the pixel driving circuit of the present disclosure will be described.

Figure 5A:
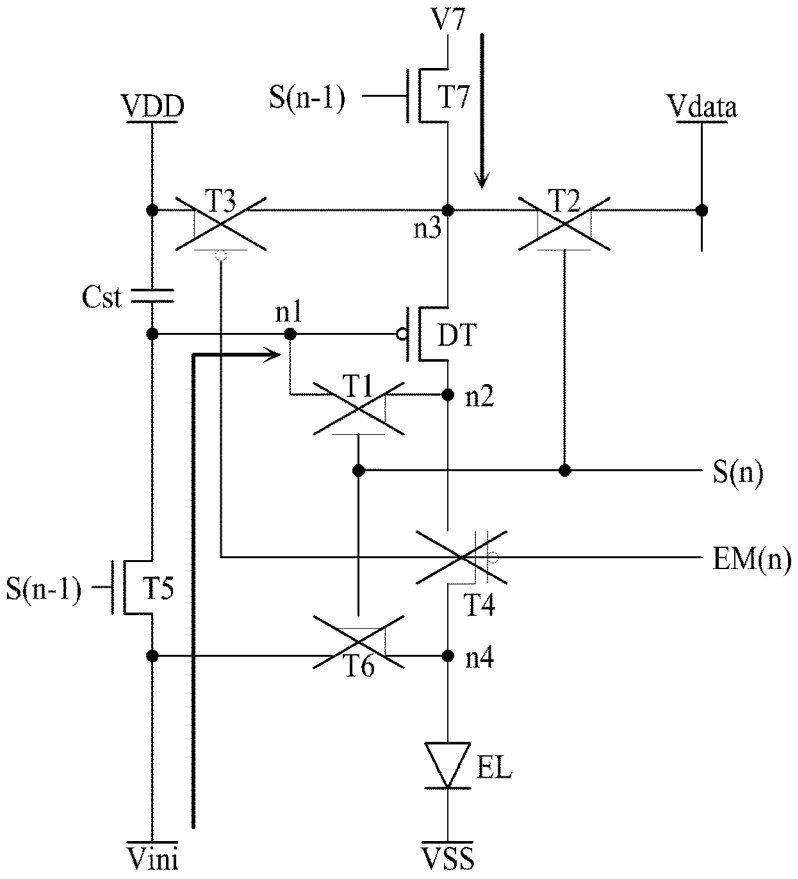
FIGS. 5A, 6A and 7A are views illustrating driving steps of a pixel driving circuit.
Figure 5B:
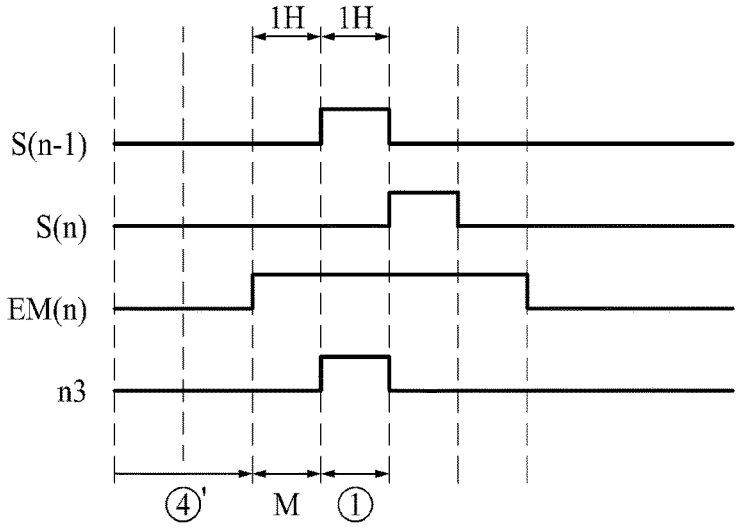
FIGS. 5B, 6B and 7B are waveforms illustrating signals input/output during a corresponding driving step according to one embodiment of the present disclosure.
Figure 6A:
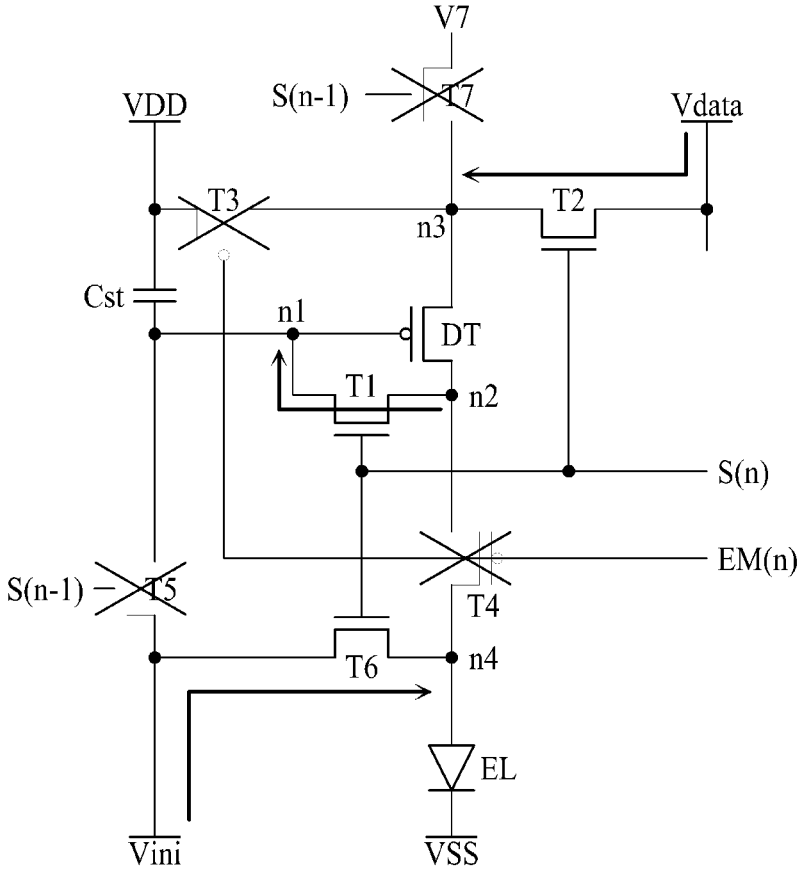
Figure 6B:
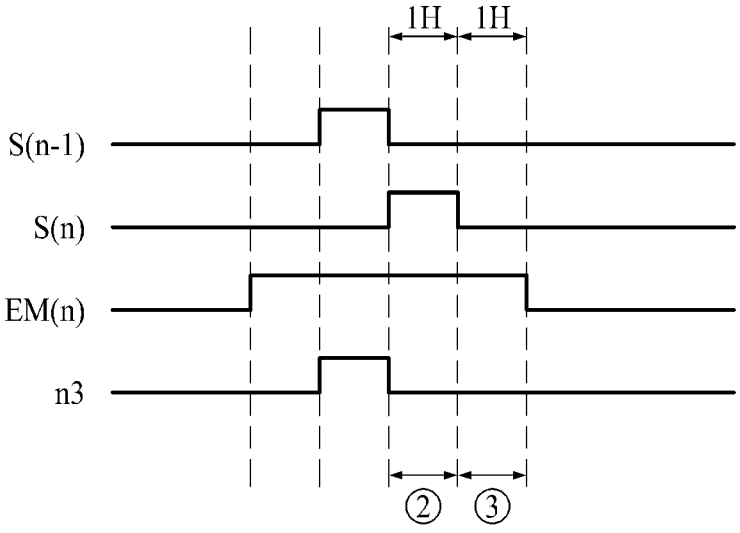
Figure 7A:
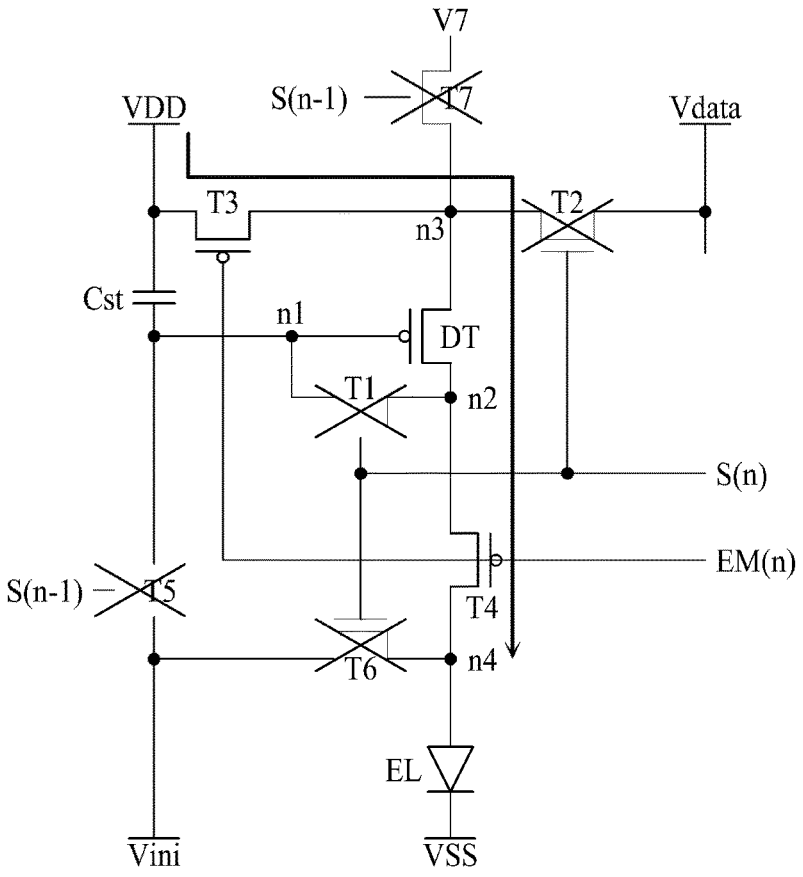
Figure 7B:
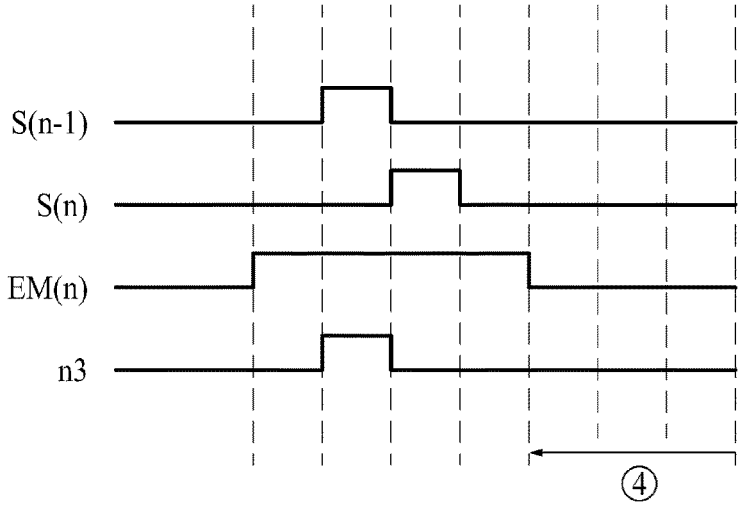

FIGS. 5A, 6A and 7A are views illustrating driving steps of a pixel driving circuit, and FIGS. 5B, 6B and 7B are waveforms illustrating signals input/output during a corresponding driving step. A mark X in the drawings indicates that the transistor is turned off.

FIG. 5A illustrates the initialization period ①, and FIG. 5B is a waveform of signals input/output for the initialization period ①. The initialization period ① has one horizontal scanning time (1H Time), and is controlled by the (n−1)th scan signal S(n−1). The (n−1)th scan signal S(n−1) has an on-level pulse for the initialization period ①, and has an off-level pulse for the other periods except the initialization period ①. While the (n−1)th scan signal S(n−1) has an on-level pulse, the nth scan signal S(n) and the nth emission signal EM(n) have an off-level pulse. In this case, in order to prevent the light emitting diode EL from emitting light due to the nth emission signal EM(n) and the (n−1)th scan signal S(n−1) which are mixed with each other in the pixel driving circuit, the nth emission signal EM(n) has a margin period M prior to the initialization period ① and is switched to a state of the off-level pulse. For example, the margin period M may be, but not limited to, one horizontal scanning time (1H Time).

For the initialization period ①, the first switching circuit (T5, T7) and the driving transistor DT are turned on, and the second switching circuit (T1, T2, T6) and the light emitting control circuit (T3, T4) are turned off.

For the initialization period ①, the fifth transistor T5 is turned on to provide the initialization voltage Vini to the gate of the driving transistor DT, and the seventh transistor T7 is turned on to provide the voltage V7 to the source of the driving transistor DT, thereby turning on the driving transistor DT. As noted from the above result, prior to the sampling period ②, the threshold voltage of the driving transistor sensed for the sampling period ② is affected by the state of the source node of the driving transistor DT. Therefore, a certain voltage is applied to the source node of the driving transistor DT for the initialization period ①, whereby the threshold voltage of the driving transistor may be prevented from being changed. Particularly, when the light emitting period ④' prior to the current frame displays a black screen of a low gray scale and the current frame displays a bright screen of a high gray scale, since a luminance change greatly occurs due to a change of the threshold voltage of the driving transistor, a certain voltage should be applied to the source of the driving transistor for the initialization period ①. In this case, the voltage V7 provided to the source of the driving transistor DT is a fixed voltage, and may be any one of the high potential voltage VDD, the initialization voltage Vini, and the nth emission voltage EM(n). Since a signal directly input from a power IC, such as the high potential voltage VDD or the initialization voltage Vini, is more preciseness than that of a signal, such as the nth emission voltage EM(n), input through a buffer such as an emission driving circuit, it may mainly be used as the voltage V7. Therefore, the voltage V7 may be any one of power voltages provided to the pixel driving circuit through the power line 4*b*.

Also, for the initialization period ①, the first node n1 maintains the state of the initialization voltage Vini to turn on the driving transistor DT and applies a certain stress to the driving transistor DT. In this case, the initialization period ① is required not to be overlapped with the sampling period ②. A stress may be applied to the driving transistor DT for a certain time through the initialization period ①, whereby luminance deterioration of the first frame, which occurs due to hysteresis of the driving transistor, may be reduced. As described above, since luminance deterioration of the first frame occurs remarkably during low-speed driving, a certain stress may be applied to the driving transistor DT to reduce luminance deterioration from occurring, whereby the display panel capable of being driven at a low speed may be embodied. The display panel capable of being driven at a low speed may reduce power consumption as compared with the display panel incapable of being driven at a low speed.

For the initialization period ①, the fifth transistor T5 is turned on to provide the initialization voltage Vini to the first node n1, whereby capacitance corresponding to a difference between the high potential voltage VDD and the initialization voltage Vini is stored in the capacitor Cst.

FIG. 6A illustrates a sampling period ② and a holding period ③ of the driving steps of the pixel driving circuit, and FIG. 6B is a waveform of signals input/output for the sampling period ②. The sampling period ② has one horizontal scanning time (1H Time), and is controlled by the nth scan signal S(n). The nth scan signal S(n) has an on-level pulse for the sampling period ②, and has an off-level pulse for the other periods except the sampling period ②.

For the sampling period ②, the second switching circuit (T1, T2, T6) and the driving transistor DT are turned on, and the first switching circuit (T5, T7) and the light emitting control circuit (T3, T4) are turned off.

For the sampling period ②, the first transistor T1 is turned on to connect the gate of the driving transistor DT with the drain of the driving transistor DT, whereby the driving transistor DT is diode-connected and thus turned on. A voltage of the first node n1 which is a gate node of the turned-on driving transistor DT is increased until the gate-source voltage Vgs becomes the threshold voltage Vth of the driving transistor DT. The second transistor T2 is turned on to provide the data voltage Vdata to the third node n3. The sixth transistor T6 is turned on to provide the initialization voltage Vini to the anode of the light emitting diode EL, thereby discharging the anode of the light emitting diode EL to the initialization voltage Vini. Since the initialization voltage Vini is lower than the low potential voltage VSS, the light emitting diode EL does not emit light.

For the sampling period ②, the voltage of the first node n1 is increased to be a sum of the data voltage Vdata and the threshold voltage Vth of the driving transistor DT, and the capacitor Cst senses the threshold voltage Vth of the driving transistor DT. In this case, a voltage which is a sum of the data voltage Vdata and the threshold voltage Vth is stored in one electrode of the capacitor Cst, and the high potential voltage VDD is stored in the other electrode of the capacitor Cst.

Since the aforementioned scan signals S(n−1) and S(n) for controlling the initialization period ① and the sampling period ② are provided from the same scan driving circuit, the initialization period ① and the sampling period ② are the same as each other. However, the time for applying a stress to the driving transistor DT or the time for sensing the threshold voltage Vth of the driving transistor DT is set to be controlled, the gate driving circuit may be embodied such that the scan signal for controlling the first switching circuit and the scan signal for controlling the second switching circuit are provided from their respective scan driving circuits.

The holding period ③ subsequent to the sampling period ② has one horizontal scanning time (1H Time), and may be controlled by the nth emission signal EM(n). For the holding period ③, the (n−1)th scan signal S(n−1), the nth scan signal S(n), and the nth emission signal EM(n) are off-level pulses. The holding period ③ is maintained until the nth emission signal EM(n) is switched to the on-level pulse. The nth emission signal EM(n) maintains the off-level pulse for two-horizontal scanning time when it is overlapped with the (n−1)th scan signal S(n−1) and the nth scan signal S(n).

The holding period ③ may allow the nth emission signal EM(n) and the scan signal S(n), which are on-level pulses, not to be mixed with each other in the same manner as the aforementioned margin period M. FIG. 6B shows that the holding period ③ is, but not limited to, one horizontal scanning period (1H Time).

FIG. 7A illustrates a light emission period ④ of the driving steps of the pixel driving circuit, and FIG. 7B is a waveform of signals input/output for the light emission period ④. The light emission period ④ occupies most of one frame period, and is controlled by the nth emission signal EM(n). The nth emission signal EM(n) has an on-level pulse for the light emission period ④, and has an off-level pulse for the other periods except the light emission period ④. For the light emission period ④, the (n−1)th scan signal S(n−1) and the nth scan signal S(n) are all off-level pulses.

For the light emission period ④, the first switching circuit (T5, T7) and the second switching circuit (T1, T2, T6) are turned off, and the light emitting control circuit (T3, T4) and the driving transistor DT are turned on.

For the light emission period ④, the third transistor T3 is turned on to provide the high potential voltage VDD to the third node n3. The driving transistor DT is turned on by the first node n1 and the third node n3 to provide the driving current to the anode of the light emitting diode EL. In this case, the driving current $I_{oled}$ is expressed by the following Equation 1.

$$I_{oled}=K(Vgs-Vth)^2=K(\mathrm{VDD}-V\mathrm{data})^2 \quad \text{[Equation 1]}$$

In this case, K is a constant that reflects a channel length, a channel width, parasitic capacitance between gate and active, and mobility, which are characteristics of the driving transistor DT. Referring to Equation 1, since the threshold voltage Vth of the driving transistor DT is removed from the driving current $I_{oled}$, the driving current $I_{oled}$ does not depend on the threshold voltage Vth of the driving transistor DT and is not affected by a change of the threshold voltage Vth. If there is a change in the threshold voltage Vth of the driving transistor as a certain voltage is not applied to the source node of the driving transistor for the initialization period ①, a change equivalent to the difference in the threshold voltage of the driving transistor also occurs in the driving current, whereby non-uniform luminance may occur.

Figure 8A:
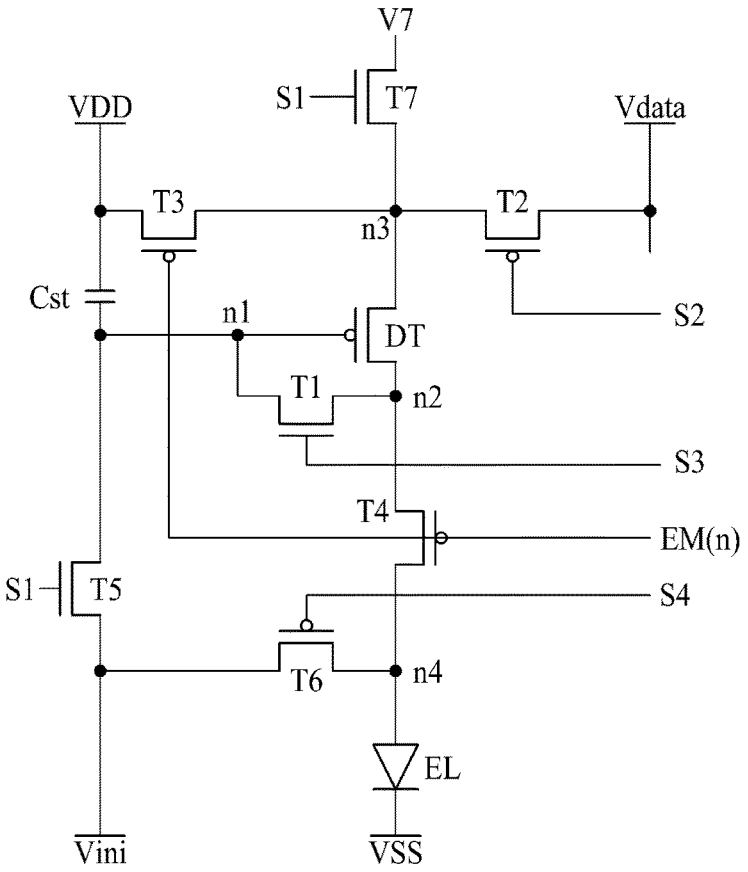
FIG. 8A is a view illustrating a pixel driving circuit according to one embodiment of the present disclosure.
Figure 8B:
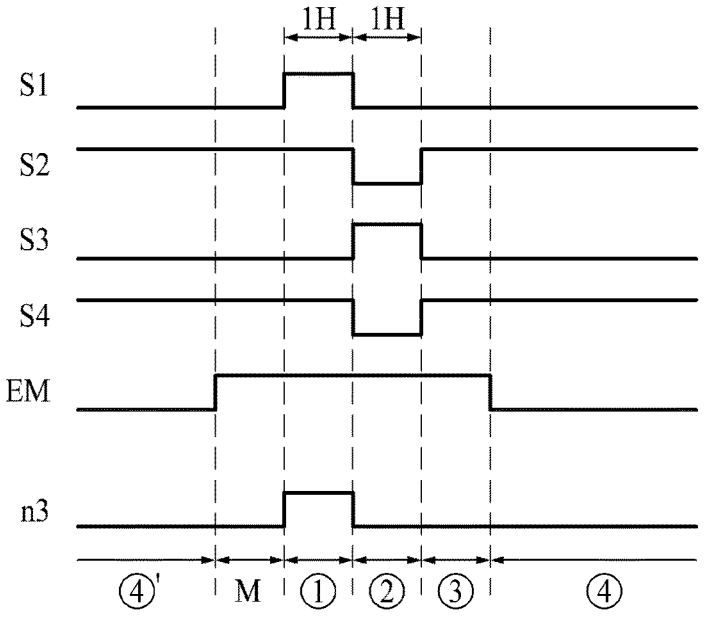
FIG. 8B is a waveform illustrating signals input/output to a pixel driving circuit.

FIG. 8A is a view illustrating a pixel driving circuit according to one embodiment of the present disclosure, and FIG. 8B is a waveform illustrating signals input/output to a pixel driving circuit. The pixel driving circuit shown in FIG. 8A relates to pixels arranged in the nth row. The pixel driving circuit of FIG. 8A is a modified example of the pixel driving circuit of FIG. 4A, and thus its repeated description will be omitted or simplified.

Referring to FIG. 8A, the pixel driving circuit for supplying the driving current to the light emitting diode EL includes a plurality of transistors and a capacitor. The pixel driving circuit according to one embodiment of the present disclosure is an internal compensation circuit that may compensate for the threshold voltage of the driving transistor DT.

A power voltage of a high potential voltage VDD, a low potential voltage VSS, and an initialization voltage Vini are applied to the pixel driving circuit, and a pixel driving signal of a first scan signal S1, a second scan signal S2, a third scan signal S3, a fourth scan signal S4, an emission signal EM and the data voltage Vdata are applied thereto. The first scan signal S1 to the fourth scan signal S4 are scan signals applied to the pixels arranged in the nth row, and the emission signal EM is an emission signal applied to the pixels arranged in the nth row.

Each of the scan signals S1, S2, S3 and S4 and the emission signal EM has an on-level pulse or an off-level pulse in accordance with a certain time interval. The transistors according to one embodiment of the present disclosure may be embodied as PMOS and NMOS transistors.

The anode of the light emitting diode EL may be connected to the driving transistor or an emission transistor for controlling light emission of the light emitting diode EL. The cathode of the light emitting diode EL is connected to a low potential voltage electrode to which the low potential voltage VSS is applied.

The driving transistor DT is a driving device for controlling a current flowing in the light emitting diode EL in accordance with the gate-source voltage Vgs and may be a PMOS transistor. However, the present disclosure is not limited thereto, and the driving transistor DT may also be a NMOS transistor. The driving transistor DT includes a gate connected to a first node n1, a drain connected to a second node n2, and a source connected to a third node n3.

A connection relation of the elements of the pixel driving circuit in FIG. 8A is the same as that of the pixel driving circuit in FIG. 2A. However, the types of the scan signals for controlling each transistor and the types of the transistors may be different between FIG. 2A and FIG. 8A.

A first transistor T1 is turned on by the third scan signal S3 and connects the gate of the driving transistor DT with the drain of the driving transistor DT. A second transistor T2 is turned on by the second scan signal S2 and provides the data voltage Vdata to the third node n3. A third transistor T3 is turned on by the emission signal EM and provides the high potential voltage VDD to the third node n3. A fourth transistor T4 is turned on by the emission signal EM and provides the driving current provided by the driving transistor DT to the anode of the light emitting diode EL. A fifth transistor T5 is turned on by the first scan signal S1 and provides the initialization voltage Vini to the first node n1. A sixth transistor T6 is turned on by the fourth scan signal S4 and provides the initialization voltage Vini to the fourth node n4. A seventh transistor T7 is turned on by the first scan signal S1 and provides the voltage V7 to the third node n3.

A capacitor Cst includes two electrodes for forming capacitance, and the two electrodes are respectively connected to the first node n1 and the high potential voltage line.

The pixel driving circuit may be categorized into a first switching circuit, a second switching circuit, and a light emitting control circuit.

The first switching circuit of the pixel driving circuit according to one embodiment of the present disclosure is turned on by the first scan signal S1 to initialize the gate of the driving transistor DT, and may reduce luminance deterioration of the first frame from occurring by turning on the driving transistor DT for a certain time after applying the voltage to the source of the driving transistor DT. The first switching circuit may include the fifth transistor T5 and the seventh transistor T7. The first switching circuit may be embodied as an NMOS transistor, and the seventh transistor T7 may be embodied as a PMOS transistor as the case may be.

The second switching circuit of the pixel driving circuit according to one embodiment of the present disclosure is turned on by the second scan signal S2, the third scan signal S3 and the fourth scan signal S4 to provide the data voltage Vdata to the third node n3, samples the threshold voltage of the driving transistor DT, and initializes the anode of the light emitting diode EL. The second switching circuit may include the first transistor T1, the second transistor T2, and the sixth transistor T6. The first transistor T1 of the second switching circuit may be embodied as an NMOS transistor, and the second transistor T2 and the sixth transistor T6 may be embodied as PMOS transistors.

The light emitting control circuit of the pixel driving circuit according to one embodiment of the present disclosure is turned on by the emission signal EM to provide the high potential voltage VDD to the third node n3 and provide the driving current to the light emitting diode EL. The light emitting control circuit is embodied as a PMOS transistor, and includes the third transistor T3 and the fourth transistor T4.

The first scan signal S1 and the third scan signal S3 provided to the first switching circuit and the second switching circuit are scan signals A, and the second scan signal S2 and the fourth scan signal S4 may be the same scan signals B. In this case, the first scan signal S1 is the scan signal A provided to the (n−1)th row, and the third scan signal S3 is the scan signal A provided to the nth row. The scan signal A and the scan signal B are signals output from their respective scan driving circuits.

The first transistor T1 and the fifth transistor T5 connected with the gate of the driving transistor DT of the first switching circuit and the second switching circuit may be embodied as NMOS transistors to reduce a leakage current, which may occur in the gate of the driving transistor DT, thereby improving exactness of the driving current provided to the light emitting diode EL.

Referring to FIG. 8B, FIG. 8B illustrates an initialization period ①, a sampling period ②, a holding period③, and a light emission period ④. The first scan signal S1 is an on-level pulse at the initialization period ①, the second scan signal S2, the third scan signal S3 and the fourth scan signal S4 are on-level pulses at the sampling period ②, and the emission signal EM is an on-level pulse at the light emission period ④. The holding period ③ and a margin period M allow the scan signals S1, S2, S3 and S4 not to be mixed with the emission signal EM by making sure of one horizontal scanning time (1H time). In this case, the holding period ③ and the margin period M are not limited to one horizontal scanning time (1H Time). If an ideal scan signal is provided to the pixel driving circuit, the margin period M and the holding period ③ may be omitted.

The initialization period ① has one horizontal scanning time (1H Time), and is controlled by the first scan signal S1. The first scan signal S1 has an on-level pulse for the initialization period ①, and has an off-level pulse for the other periods except the initialization period ①. In this case, in order to prevent the light emitting diode EL from emitting light due to the emission signal EM and the first scan signal S1 which are mixed with each other in the pixel driving circuit, the emission signal EM has a margin period M prior to the initialization period ① and is switched to a state of the off-level pulse. For example, the margin period M may be, but not limited to, one horizontal scanning time (1H Time).

For the initialization period ①, the first switching circuit (T5, T7) and the driving transistor DT are turned on, and the second switching circuit (T1, T2, T6) and the light emitting control circuit (T3, T4) are turned off.

For the initialization period ①, the fifth transistor T5 is turned on to provide the initialization voltage Vini to the gate of the driving transistor DT, and the seventh transistor T7 is turned on to provide the voltage V7 to the source of the driving transistor DT, thereby turning on the driving transistor DT. As noted from the above result, prior to the sampling period ②, the threshold voltage of the driving transistor sensed for the sampling period ② is affected by the state of the source node of the driving transistor DT. Therefore, a certain voltage is applied to the source node of the driving transistor DT for the initialization period ①, whereby the threshold voltage of the driving transistor may be prevented from being changed. Particularly, when a black screen of a low gray scale is displayed for the light emitting period ④' prior to the current frame and a bright screen of a high gray scale is displayed at the current frame, since a luminance change greatly occurs due to a change of the threshold voltage of the driving transistor, a certain voltage should be applied to the source of the driving transistor for the initialization period ①. In this case, the voltage V7 provided to the source of the driving transistor DT is a fixed voltage, and may be any one of the high potential voltage VDD, the initialization voltage Vini, and the emission voltage EM. Since a signal directly input from a power IC, such as the high potential voltage VDD or the initialization voltage Vini, has exactness more excellent than that of a signal, such as the nth emission voltage EM, input through a buffer such as an emission driving circuit, it may mainly be used as the voltage V7. Therefore, the voltage V7 may be any one of power voltages provided to the pixel driving circuit through the power line 4*b*.

Also, for the initialization period ①, the first node n1 maintains the state of the initialization voltage Vini to turn on the driving transistor DT and applies a certain stress to the driving transistor DT. In this case, the initialization period ① is required not to be overlapped with the sampling period ②. A stress may be applied to the driving transistor DT for a certain time through the initialization period ①, whereby luminance deterioration of the first frame, which occurs due to hysteresis of the driving transistor DT, may be reduced. As described above, since luminance deterioration of the first frame occurs remarkably during low-speed driving, a certain stress may be applied to the driving transistor DT to reduce luminance deterioration from occurring, whereby the display panel capable of being driven at a low speed may be embodied. The display panel capable of being driven at a low speed may reduce power consumption as compared with the display panel incapable of being driven at a low speed.

For the initialization period ①, the fifth transistor T5 is turned on to provide the initialization voltage Vini to the first node n1, whereby capacitance corresponding to a difference between the high potential voltage VDD and the initialization voltage Vini is stored in the capacitor Cst.

The sampling period ② subsequent to the initialization period ① has one horizontal scanning time (1H Time), and is controlled by the second scan signal S2, the third scan signal S3 and the fourth scan signal S4. The second scan signal S2, the third scan signal S3 and the fourth scan signal S4 have an on-level pulse for the sampling period ②, and have an off-level pulse for the other periods except the sampling period ②.

For the sampling period ②, the second switching circuit (T1, T2, T6) and the driving transistor DT are turned on, and the first switching circuit (T5, T7) and the light emitting control circuit (T3, T4) are turned off.

For the sampling period ②, the first transistor T1 is turned on to connect the gate of the driving transistor DT with the drain of the driving transistor DT, whereby the driving transistor DT is diode-connected and thus turned on. A voltage of the first node n1 which is a gate node of the turned-on driving transistor DT is increased until the gate-source voltage Vgs becomes the threshold voltage Vth of the driving transistor DT. The second transistor T2 is turned on to provide the data voltage Vdata to the third node n3. The sixth transistor T6 is turned on to provide the initialization voltage Vini to the anode of the light emitting diode EL, thereby discharging the anode of the light emitting diode EL to the initialization voltage Vini. Since the initialization voltage Vini is lower than the low potential voltage VSS, the light emitting diode EL does not emit light.

For the sampling period ②, the voltage of the first node n1 is increased to be a sum of the data voltage Vdata and the threshold voltage Vth of the driving transistor DT, and the capacitor Cst senses the threshold voltage Vth of the driving transistor DT. In this case, a voltage which is a sum of the data voltage Vdata and the threshold voltage Vth is stored in one electrode of the capacitor Cst, and the high potential voltage VDD is stored in the other electrode of the capacitor Cst.

The holding period ③ subsequent to the sampling period ② has one horizontal scanning time (1H Time), and may be controlled by the emission signal EM. For the holding period ③, the scan signal S1, S2, S3 and S4 and the emission signal EM are off-level pulses. The holding period ③ is maintained until the emission signal EM is switched to the on-level pulse. The emission signal EM maintains the off-level pulse for two-horizontal scanning time when it is overlapped with the scan signals S1, S2, S3 and S4.

The holding period ③ may allow the emission signal EM and the scan signal S1, S2, S3 and S4, which are on-level pulses, not to be mixed with each other in the same manner as the aforementioned margin period M. The holding period ③ is, but not limited to, one horizontal scanning period (1H Time) as shown.

The light emission period ④ subsequent to the holding period ③ occupies most of one frame period, and is controlled by the emission signal EM. The emission signal EM has an on-level pulse for the light emission period ④, and has an off-level pulse for the other periods except the light emission period ④. For the light emission period ④, the scan signals S1, S2, S3 and S4 are all off-level pulses.

For the light emission period ④, the first switching circuit (T5, T7) and the second switching circuit (T1, T2, T6) are turned off, and the light emitting control circuit (T3, T4) and the driving transistor DT are turned on.

For the light emission period ④, the third transistor T3 is turned on to provide the high potential voltage VDD to the third node n3. The driving transistor DT is turned on by the first node n1 and the third node n3 to provide the driving current to the anode of the light emitting diode EL. In this case, the driving current $I_{oled}$ is as expressed by the Equation 1. Although the threshold voltage Vth of the driving transistor DT is removed from the driving current $I_{oled}$, if there is a change in the threshold voltage Vth of the driving transistor as a certain voltage is not applied to the source node of the driving transistor for the initialization period ①, a change equivalent to the difference in the threshold voltage of the driving transistor also occurs in the driving current, whereby non-uniform luminance may occur.

The electroluminescent display device comprising the pixel driving circuit according to the embodiment of the present disclosure may be described as follows.

An electroluminescent display device according to one embodiment of the present disclosure comprises a plurality of subpixels included in an nth row and each including a pixel driving circuit driven in accordance with an initialization period, a sampling period and a light emission period. In this case, 'n' is a natural number. The pixel driving circuit includes a light emitting diode, a driving transistor including a gate connected to a first node, a drain connected to a second node, and a source connected to a third node, a first switching circuit turned on for the initialization period, providing an initialization voltage to the first node and providing a fixed voltage to the third node, a second switching circuit turned on for the sampling period, conducting the first node and the second node, applying a data voltage to the third node and providing the initialization voltage to an anode of the light emitting diode, and a light emitting control circuit controlled by an emission signal and turned on for the light emission period to provide a high potential voltage to the third node and deliver a driving current to the light emitting diode. In this case, a capacitor is connected to the first node and a high potential voltage line to which the high potential voltage is provided. Therefore, luminance deterioration occurring when the electroluminescent display device capable of being driven at a variable frequency is driven at a low speed, may be reduced.

According to another characteristic of the present disclosure, the first switching circuit may be controlled by an (n−1)th scan signal applied to subpixels arranged in a (n−1)th row, and the second switching circuit may be controlled by an nth scan signal applied to the subpixels arranged in the nth row. The emission signal may not be overlapped with an on-level pulse of the (n−1)th scan signal prior to the initialization period, and may not be overlapped with an on-level pulse of the nth scan signal after the sampling period. On-level pulse of the emission signal may be spaced apart from an on-level pulse of the (n−1)th scan signal by one horizontal scanning time, and may be spaced apart from an on-level pulse of the nth scan signal by one horizontal scanning time.

According to another characteristic of the present disclosure, the initialization voltage may be lower than the high potential voltage, and the fixed voltage may be any one of the initialization voltage, the high potential voltage and the emission signal.

According to another characteristic of the present disclosure, the first switching circuit may include a fifth transistor providing the initialization voltage to the first node, and a seventh transistor providing the fixed voltage to the third node. The fifth transistor may be an N type transistor.

According to another characteristic of the present disclosure, the second switching circuit may include a first transistor conducting the first node and the second node, a second transistor providing the data voltage to the third node, and a sixth transistor providing the initialization voltage to the anode of the light emitting diode. The first transistor may be an N type transistor.

According to another characteristic of the present disclosure, the light emitting control circuit may include a third transistor providing the high potential voltage to the third node, and a fourth transistor conducting the second node and the anode.

According to another characteristic of the present disclosure, the first switching circuit may be controlled by an (n−1)th scan signal, and the second switching circuit may be controlled by the (n−1)th scan signal and an nth scan signal.

An electroluminescent display device according to one embodiment of the present disclosure comprises a plurality of subpixels included in an nth row and each including a pixel driving circuit driven in accordance with an initialization period, a sampling period and a light emission period where n is a natural number. the pixel driving circuit includes a light emitting diode and a driving transistor, and is configured to initialize a voltage of a gate of the driving transistor during the initialization period, to perform threshold voltage compensation and data voltage charging of the driving transistor during the sampling period, and to make the light emitting diode emit light during the light emission period. The pixel driving circuit is configured to provide a fixed voltage to a source of the driving transistor during the initialization period.

It will be apparent to those skilled in the art that the present disclosure described above is not limited by the above-described embodiments and the accompanying drawings and that various substitutions, modifications, and variations can be made in the present disclosure without departing from the spirit or scope of the disclosures. Consequently, the scope of the present disclosure is defined by the accompanying claims, and it is intended that all variations or modifications derived from the meaning, scope, and equivalent concept of the claims fall within the scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. An electroluminescent display device comprising a plurality of subpixels included in an nth row and each including a pixel driving circuit driven in accordance with an initialization period, a sampling period and a light emission period where n is a natural number, wherein the pixel driving circuit includes:

a light emitting diode;

a driving transistor including a gate connected to a first node, a drain connected to a second node, and a source connected to a third node;

a first switching circuit turned on for the initialization period, providing an initialization voltage to the first node and providing a fixed voltage to the third node;

a second switching circuit turned on for the sampling period, conducting the first node and the second node, applying a data voltage to the third node and providing the initialization voltage to an anode of the light emitting diode; and a light emitting control circuit controlled by an emission signal and turned on for the light emission period to provide a high potential voltage to the third node and deliver a driving current to the light emitting diode, wherein during the initialization period, a predefined stress is applied to the source of the driving transistor, wherein the first switching circuit is controlled by a (n−1)th scan signal applied to subpixels arranged in a (n−1)th row, and the second switching circuit is controlled by a nth scan signal applied to the plurality of subpixels arranged in the nth row, and wherein the (n−1)th scan signal and the nth scan signal are overlapped with each other in the sampling period.

2. The electroluminescent display device of claim 1, wherein the pixel driving circuit further includes a capacitor connected to the first node and a high potential voltage line to which the high potential voltage is provided.

3. The electroluminescent display device of claim 1, wherein the emission signal is not overlapped with an on-level pulse of the (n−1)th scan signal prior to the initialization period, and is not overlapped with an on-level pulse of the nth scan signal after the sampling period.

4. The electroluminescent display device of claim 1, wherein on-level pulse of the emission signal is spaced apart from an on-level pulse of the (n−1)th scan signal by one horizontal scanning time, and is spaced apart from an on-level pulse of the nth scan signal by one horizontal scanning time.

5. The electroluminescent display device of claim 1, wherein the initialization voltage is lower than the high potential voltage, and the fixed voltage is any one of the initialization voltage, the high potential voltage, or the emission signal.

6. The electroluminescent display device of claim 1, wherein the first switching circuit includes:

a fifth transistor providing the initialization voltage to the first node; and a seventh transistor providing the fixed voltage to the third node.

7. The electroluminescent display device of claim 6, wherein the fifth transistor is a N type transistor.

8. The electroluminescent display device of claim 1, wherein the second switching circuit includes:

a first transistor conducting the first node and the second node;

a second transistor providing the data voltage to the third node; and a sixth transistor providing the initialization voltage to the anode of the light emitting diode.

9. The electroluminescent display device of claim 8, wherein the first transistor is a N type transistor.

10. The electroluminescent display device of claim 1, wherein the light emitting control circuit includes:

a third transistor providing the high potential voltage to the third node; and a fourth transistor conducting the second node and the anode.

11. The electroluminescent display device of claim 1, wherein the first switching circuit is controlled by a (n−1)th scan signal, and the second switching circuit is controlled by the (n−1)th scan signal and an nth scan signal.

12. An electroluminescent display device comprising a plurality of subpixels included in an nth row and each including a pixel driving circuit driven in accordance with an initialization period, a sampling period and a light emission period where n is a natural number, wherein the pixel driving circuit includes:

a light emitting diode; and a driving transistor, wherein the pixel driving circuit is configured to initialize a voltage of a gate of the driving transistor during the initialization period, to perform threshold voltage compensation and data voltage charging of the driving transistor during the sampling period, and to make the light emitting diode emit light during the light emission period, wherein the pixel driving circuit is configured to provide a fixed voltage to a source of the driving transistor during the initialization period, wherein during the initialization period, a predefined stress is applied to a source of the driving transistor, wherein the pixel driving circuit is controlled by a (n−1)th scan signal applied to subpixels arranged in a (n−1)th row and a nth scan signal applied to the plurality of subpixels arranged in the nth row, and wherein the (n−1)th scan signal and the nth scan signal are overlapped with each other in the sampling period.

* * * * *